US010016767B2

(12) United States Patent
Spiegel et al.

(10) Patent No.: US 10,016,767 B2
(45) Date of Patent: Jul. 10, 2018

(54) CENTRIFUGATION SYSTEMS WITH NON-CONTACT SEAL ASSEMBLIES

(71) Applicant: Alfa Wassermann, Inc., West Caldwell, NJ (US)

(72) Inventors: Kurt Michael Spiegel, Pearl River, NY (US); Eric Bernard Weiland, Mount Tabor, NJ (US)

(73) Assignee: Alfa Wassermann, Inc., West Caldwell, NJ (US)

( * ) Notice: Subject to any disclaimer, the term of this patent is extended or adjusted under 35 U.S.C. 154(b) by 707 days.

(21) Appl. No.: 14/602,305

(22) Filed: Jan. 22, 2015

(65) Prior Publication Data

US 2015/0202635 A1 Jul. 23, 2015

Related U.S. Application Data

(60) Provisional application No. 61/930,173, filed on Jan. 22, 2014.

(51) Int. Cl.

| | |
|---|---|
| ***B04B 9/00*** | (2006.01) |
| ***B04B 9/02*** | (2006.01) |
| ***B04B 9/04*** | (2006.01) |
| ***B04B 9/06*** | (2006.01) |
| ***B04B 9/12*** | (2006.01) |
| ***B04B 15/02*** | (2006.01) |
| ***B04B 15/00*** | (2006.01) |

(52) U.S. Cl.

CPC ..... *B04B 15/00* (2013.01); *B04B 9/00* (2013.01); *B04B 9/02* (2013.01); *B04B 9/04* (2013.01); *B04B 9/06* (2013.01); *B04B 9/12* (2013.01); *B04B 15/02* (2013.01)

(58) Field of Classification Search

CPC .. B04B 15/00; B04B 9/04; B04B 9/12; B04B 9/00; B04B 15/02; B04B 9/02; B04B 9/06; B04B 7/02; B04B 13/00

USPC ..... 494/41

See application file for complete search history.

(56) References Cited

U.S. PATENT DOCUMENTS

| | | | |
|---|---|---|---|
| 2,913,169 | A | 11/1959 | Wilhelm |
| 3,430,849 | A | 3/1969 | Nunley et al. |
| 3,502,954 | A | 3/1970 | Moore et al. |
| 3,759,591 | A | 9/1973 | Wright et al. |

(Continued)

FOREIGN PATENT DOCUMENTS

| | | | |
|---|---|---|---|
| EP | 0930099 | A | 7/1999 |
| JP | 2003336234 | A | 11/2003 |

OTHER PUBLICATIONS

Gau et al; "Computational Fluid Dynamic and Rotordynamic Study on the Labyrinth Seal"; Dissertation submitted to the Virginia Polytechnic Institute and State University; Jun. 14, 2012; pp. 1-123.

(Continued)

*Primary Examiner* — Charles Cooley

(74) *Attorney, Agent, or Firm* — Ohlandt, Greeley, Ruggiero & Perle, L.L.P.

(57) ABSTRACT

Centrifugation systems are provided that have a non-contact seal assemblies including an upper guard and a skirted pivot, as well as a pressure source that provides a gas flow between the upper guard and a surface of the skirted pivot. In some embodiments, the non-contact seal assembly further includes a lower guard having one or more capillary channels defined on an upper surface.

23 Claims, 15 Drawing Sheets

(56) References Cited

U.S. PATENT DOCUMENTS

| | | | | |
|---|---|---|---|---|
| 4,011,972 | A | 3/1977 | Pederson et al. | |
| 4,205,779 | A | 6/1980 | Jacobson | |
| 4,226,359 | A | 10/1980 | Jacobson | |
| 4,250,752 | A | 2/1981 | Ongley et al. | |
| 4,412,707 | A * | 11/1983 | Buffet | F16C 27/08 384/606 |
| 4,502,699 | A * | 3/1985 | Mukerji | B04B 5/0442 277/398 |
| 4,654,023 | A * | 3/1987 | Foldhazy | B04B 9/12 277/362 |
| 4,941,866 | A * | 7/1990 | Gorodissky | B04B 15/02 494/14 |
| 4,946,433 | A * | 8/1990 | Gorodissky | B04B 9/02 184/31 |
| 4,997,340 | A | 3/1991 | Zinsmeyer et al. | |
| 6,290,234 | B1 | 9/2001 | Eberle et al. | |
| 6,837,676 | B2 | 1/2005 | Yuri et al. | |
| 7,144,361 | B2 | 12/2006 | Aizawa et al. | |
| 7,794,383 | B2 | 9/2010 | Tetsu et al. | |
| 7,901,342 | B2 | 3/2011 | Tobita et al. | |
| 7,909,751 | B2 * | 3/2011 | Tobita | A61L 2/07 494/14 |
| 8,038,592 | B2 * | 10/2011 | Toi | B04B 5/0442 494/14 |
| 8,192,343 | B2 * | 6/2012 | Spiegel | B04B 7/02 494/14 |
| 2005/0215410 | A1 | 9/2005 | Merino et al. | |
| 2006/0009341 | A1 | 1/2006 | Tobita et al. | |
| 2009/0197752 | A1 | 8/2009 | Spiegel et al. | |
| 2010/0081553 | A1 | 4/2010 | Aizawa | |
| 2012/0220441 | A1 * | 8/2012 | Spiegel | G06F 17/30867 494/10 |
| 2015/0202635 | A1 * | 7/2015 | Spiegel | B04B 15/00 494/14 |

OTHER PUBLICATIONS

John S. Stahley; "Dry Gas Seal System Design Standards for Centrifugal Compressor Applications"; Proceedings of the Thirty-First Turbomachinery Symposium; 2002; pp. 145-152.

Canadian Examiners Report dated Feb. 22, 2016 from corresponding Canadian Application No. 2,878,645, 4 pages.

European Search Report dated May 11, 2015 for European application No. EP 15152185.

* cited by examiner

CENTRIFUGATION SYSTEMS WITH NON-CONTACT SEAL ASSEMBLIES

CROSS REFERENCE TO RELATED APPLICATIONS

This application claims the benefit of U.S. Provisional Application Ser. No. 61/930,173 filed Jan. 22, 2014 the contents of which are incorporated by reference herein.

BACKGROUND OF THE INVENTION

1. Field of the Invention

The present disclosure is related to centrifugation systems. More particularly, the present disclosure is related to centrifugation systems with improved non-contact seal assemblies.

2. Description of Related Art

Centrifugal separation is commonly used to separate a solution into its constituent parts based on the density of the constituents. Here, the centrifugation system creates a centrifugal force field by spinning the solution containing the constituents to be separated, thus causing the constituents of higher density to separate from the solution.

Many different styles of centrifugation systems have been used and are typically classified by, among other things, the flow in the system (e.g., batch or continuous flow) and by the speed by the centrifugation (e.g., ultra-centrifugation). By way of example, common continuous ultra-centrifugation systems rotate the rotor at speeds of more than 40,500 revolutions per minute using pneumatic drives or electric drives.

It has been determined by the present disclosure that some prior art centrifugation systems can experience undesired leakage of fluids into the electric motor, hydraulic drive, or pneumatic drive, causing premature failure.

Accordingly, it has been determined that there is a need for centrifugation systems that overcome, alleviate, and/or mitigate one or more of the aforementioned and other deleterious effects of the prior art systems.

SUMMARY

A centrifugation system is provided that has a non-contact seal assembly to mitigate leakage of fluids.

In some embodiments, the non-contact seal assembly includes a lower guard having one or more capillary channels defined therein.

In other embodiments, the non-contact seal assembly includes a pressure source that maintains a gas flow in a direction that is counter to a leaking flow.

A centrifugation system is provided that has a non-contact seal assembly including an upper guard and a skirted pivot, as well as a pressure source that provides a gas flow between the upper guard and a surface of the skirted pivot. In some embodiments, the non-contact seal assembly further includes a lower guard having one or more capillary channels defined on an upper surface.

A centrifugation system is provided that includes a drive assembly, a non-contact seal assembly, and a tank assembly. The drive assembly has an upper housing and a lower housing separated by a top bearing plate with a rotor opening defined therein. The lower housing has a drive disposed therein with a rotor shaft aligned with the rotor opening. The non-contact seal assembly has an upper guard and a skirted pivot. The non-contact seal assembly is secured to the top bearing plate at the rotor opening so that the skirted pivot is operatively coupled to the rotor shaft for rotation without contacting the upper guard with the upper guard and the skirted pivot forming a labyrinth seal to mitigate leakage of fluid from the upper housing through the rotor opening into the drive in the lower housing. The tank assembly has a centrifuge rotor rotatably housed therein. The tank assembly is connectable to the lower housing so that the centrifuge rotor is rotatably driven by the drive via the skirted pivot.

In some embodiments, the drive is a pneumatic drive or an electric.

In other embodiments alone or in combination with one or more of the aforementioned or aftmetioned embodiments, the centrifugation system can further include a pressure source providing a gas flow between a lower surface of the upper guard and an upper surface of the skirted pivot. The gas flow has a direction opposite to a fluid leaking direction through the rotor opening.

In other embodiments alone or in combination with one or more of the aforementioned or aftmetioned embodiments, the pressure source is sufficient to remove heat from the drive.

In other embodiments alone or in combination with one or more of the aforementioned or aftmetioned embodiments, the pressure source is a positive or negative pressure source.

In other embodiments alone or in combination with one or more of the aforementioned or aftmetioned embodiments, the centrifugation system can further include a lower guard secured to the upper guard with the skirted pivot rotatably positioned therebetween without contacting the upper or lower guards.

In other embodiments alone or in combination with one or more of the aforementioned or aftmetioned embodiments, the lower guard includes a capillary channel defined on an upper surface, the capillary channel being sloped away from the rotor opening.

In other embodiments alone or in combination with one or more of the aforementioned or aftmetioned embodiments, the upper surface of the skirted pivot has an outer dimension that is larger than an inner dimension of an opening within the lower guide.

In other embodiments alone or in combination with one or more of the aforementioned or aftmetioned embodiments, the upper surface has an angle with respect to a vertical axis through a central axis of the skirted pivot, the angle being sufficient so that fluid captured on the skirted pivot is guided towards the outer dimension.

In other embodiments alone or in combination with one or more of the aforementioned or aftmetioned embodiments, the skirted pivot forms a wear point at a tip of the rotor shaft of the drive.

In other embodiments alone or in combination with one or more of the aforementioned or aftmetioned embodiments, the skirted pivot is removably received in the non-contact seal assembly so that the skirted pivot is replaceable.

In other embodiments alone or in combination with one or more of the aforementioned or aftmetioned embodiments, the centrifugation system can further include one or more features on seal surfaces of the upper guard and/or skirted pivot. The one or more features forming fluid vortices within the non-contact seal assembly sufficient to mitigate leakage of the fluid from the upper housing through the rotor opening into the drive in the lower housing.

In other embodiments alone or in combination with one or more of the aforementioned or aftmetioned embodiments, the centrifugation system can further include a pressure source providing a gas flow between a lower surface of the upper guard and an upper surface of the skirted pivot, the gas flow having a direction opposite to a fluid leaking direction through the rotor opening.

In other embodiments alone or in combination with one or more of the aforementioned or aftmetioned embodiments, the gas flow is sufficient to overcome any vortices and/or pressure differentials generated by the rotation of the skirted pivot.

In other embodiments alone or in combination with one or more of the aforementioned or aftmetioned embodiments, the bearing plate is sloped away from the rotor opening so that fluid captured by and exiting the non-contact seal assembly is directed to an outer periphery.

In other embodiments alone or in combination with one or more of the aforementioned or aftmetioned embodiments, the bearing plate further comprises an outlet port at the outer periphery through which fluid can be evacuated from the drive assembly.

In other embodiments alone or in combination with one or more of the aforementioned or aftmetioned embodiments, the centrifugation system can further include an evacuation pump providing a gas flow between a lower surface of the upper guard and an upper surface of the skirted pivot. The gas flow has a direction opposite to a fluid leaking direction through the rotor opening. The evacuation pump also evacuating fluid from the outlet port at the outer periphery.

A centrifugation system is also provided that has a drive, a bearing plate, a non-contact seal assembly sealing, and a pressure source. The drive has a rotor shaft. The bearing plate has a rotor opening aligned with the rotor shaft. The non-contact seal assembly seals the rotor opening and includes an upper guard and a skirted pivot. The skirted pivot is connected to the rotor shaft for rotation by the drive without contacting the upper guard. The pressure source provides a gas flow between a lower surface of the upper guard and an upper surface of the skirted pivot. The gas flow has a direction opposite to a fluid leaking direction through the rotor opening.

In other embodiments alone or in combination with one or more of the aforementioned or aftmetioned embodiments, the pressure source is a positive or negative pressure source.

In other embodiments alone or in combination with one or more of the aforementioned or aftmetioned embodiments, the gas flow is sufficient to overcome any vortices and/or pressure differentials generated by the rotation of the skirted pivot.

The above-described and other features and advantages of the present disclosure will be appreciated and understood by those skilled in the art from the following detailed description, drawings, and appended claims.

DETAILED DESCRIPTION

Figure 1:
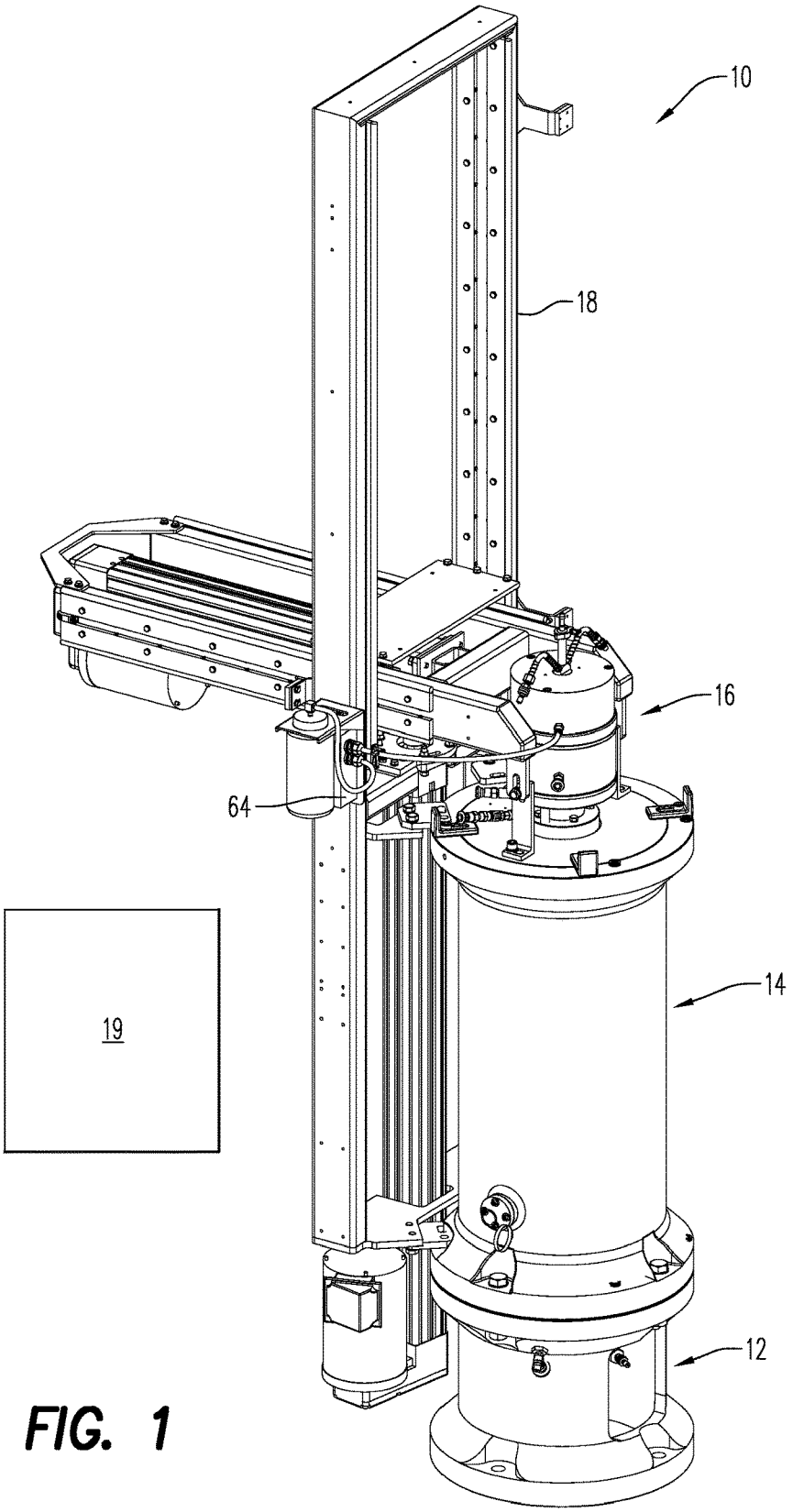
FIG. 1 is a top perspective view of an exemplary embodiment of a centrifugation system according to the present disclosure.

Referring to the drawings and in particular to FIG. 1, an exemplary embodiment of a centrifugation system according to the present disclosure is shown and is generally referred to by reference numeral 10.

Centrifugation system 10 (hereinafter "system") includes a base or stand 12, a centrifugation tank assembly 14, a drive assembly 16, and a lift assembly 18. In some embodiments, system 10 can also include a control interface 19 in electrical communication (e.g., wired, wireless, or combinations thereof) with, for example, drive assembly 16, lift assembly 18, and other components of the system described herein to allow the operator to control the various movements and operations of the system. Control interface 19 can be any human-machine-interface (HMI) such as, but not limited to, a touch screen that allows the operator to control the various components of system 10.

Advantageously, system 10 includes a non-contact seal assembly configured to mitigate leakage of fluids within drive assembly 16.

For purposes of clarity, system 10 is described herein as an ultra-centrifugation system and drive assembly 16 is described as an electric drive such that the non-contact seal assembly mitigates leakage into the electric drive. Of course, it is contemplated by the present disclosure for the non-contact seal assembly to find equal use in any device having any type of device, which has a need for a non-contact seal assembly.

Except as described herein below, base 12, centrifugation tank assembly 14, drive assembly 16, and lift assembly 18 function as disclosed in Applicant's own U.S. Pat. No. 8,192,343, the contents of which are incorporated herein by reference in their entirety. Lift assembly 18 is configured to move drive assembly 16 with respect to tank assembly 14. In some embodiments, lift assembly 18 is a two-axis lift that is configured to, under the control of the operator via interface 19, lift and remove drive assembly 16 from tank assembly 14. However, it is also contemplated by the present disclosure for lift assembly 18 to be a single-axis lift or a three-axis lift as desired.

Figure 2:
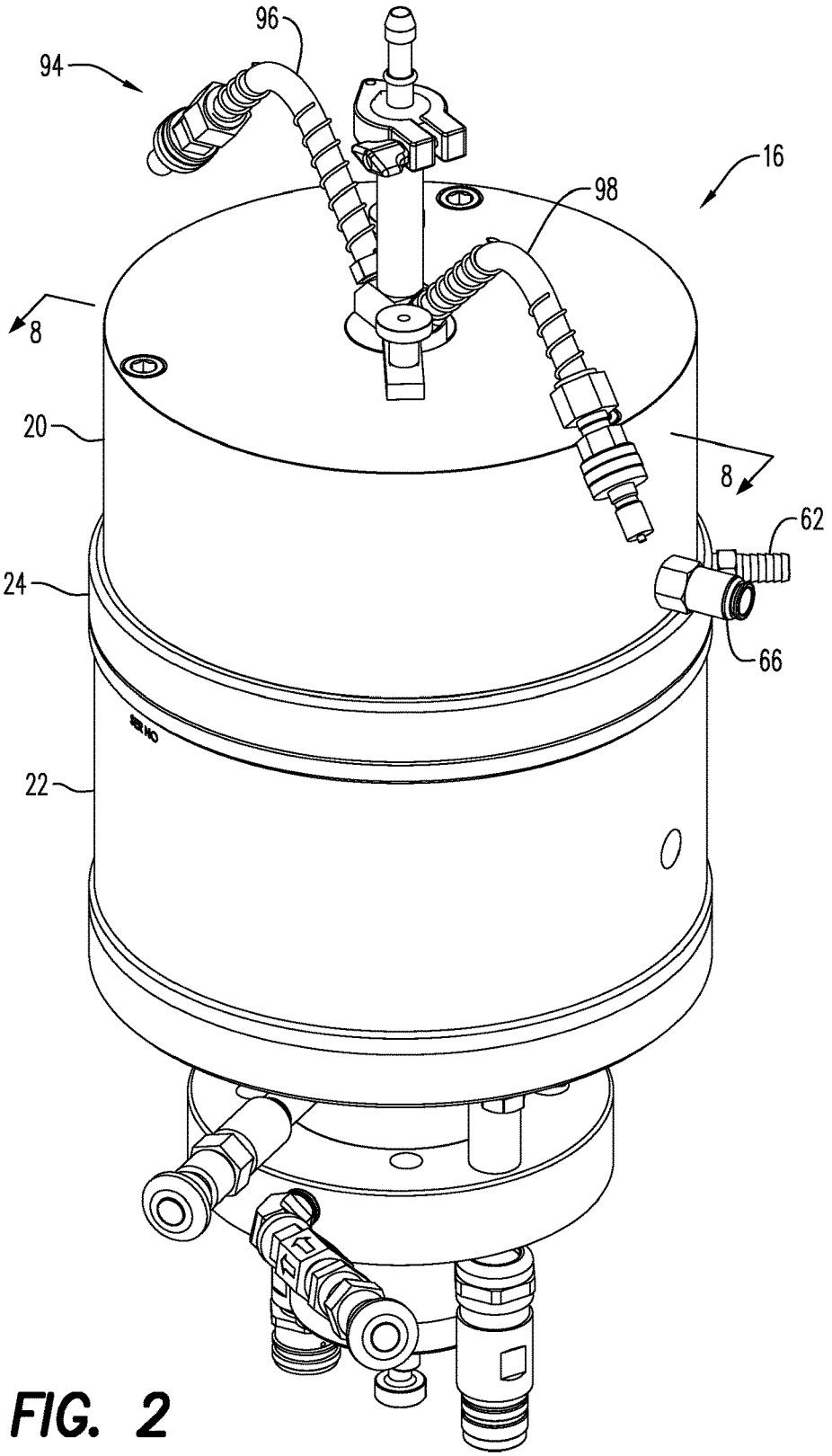
FIG. 2 is a top perspective view of a drive assembly in the system of FIG. 1.
Figure 3:
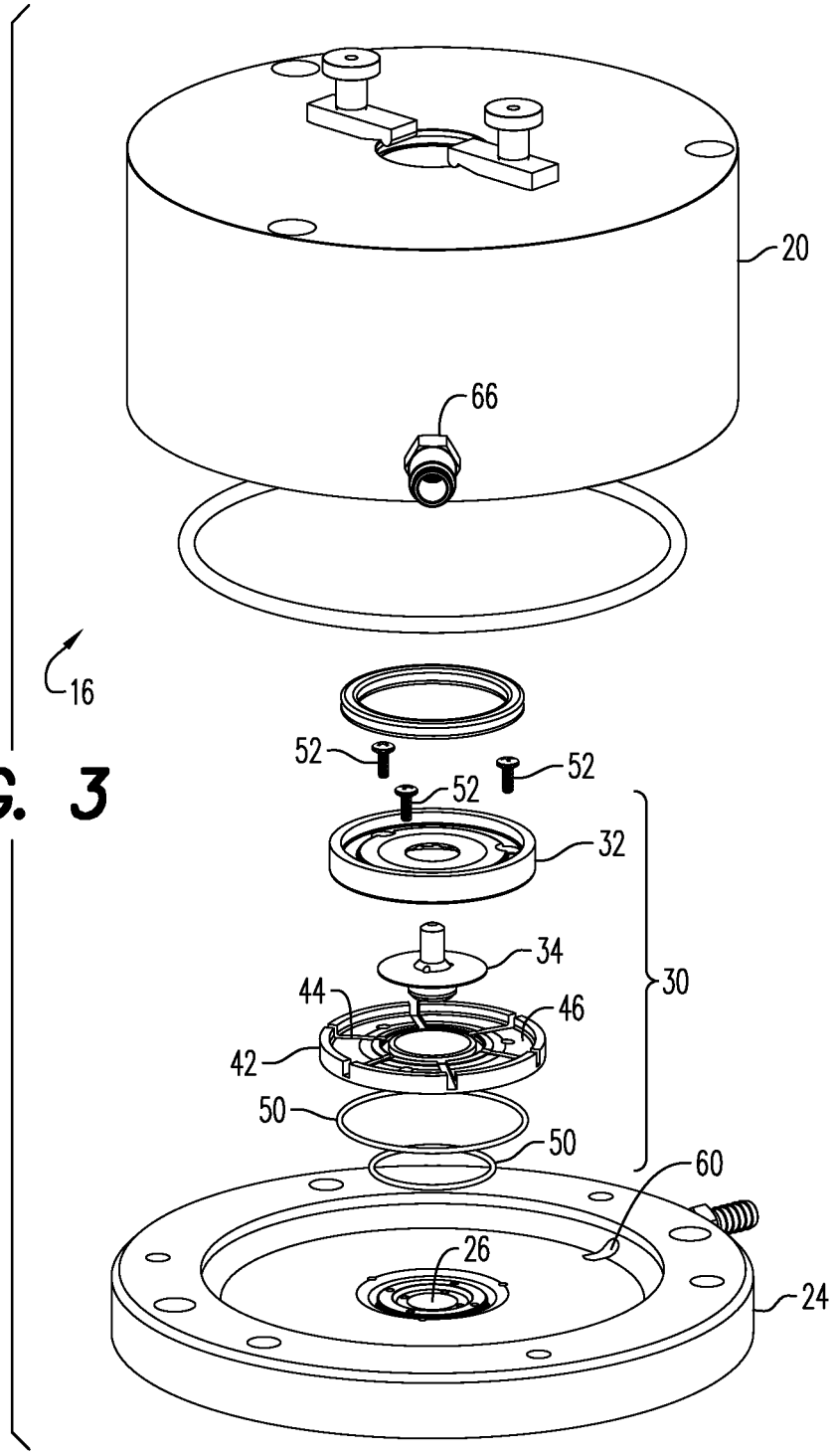
FIG. 3 is a partial exploded view of the drive assembly of FIG. 2.

Referring now to FIGS. 2 and 3, drive assembly 16 is described in more detail. Drive assembly 16 includes an upper housing 20 and a lower housing 22 separated by a top bearing plate 24. Lower housing 22 includes the rotor and stator of the electric drive such that sealing the lower housing from fluid within upper housing 20 is desired. Specifically, it is desired to prevent fluid within upper housing 20 from passing through a rotor opening 26 in top bearing plate 24 and into lower housing 22. Accordingly, drive assembly 16 includes a non-contact seal assembly 30, which mitigates leakage of fluid from upper housing 20 through rotor opening 26 into lower housing 22

As will be described in more detail below with simultaneous reference to FIGS. 2-11, non-contact seal assembly 30, in some embodiments, has an upper guard 32 and a skirted pivot 34 that form a labyrinth seal there between to mitigate leakage. The labyrinth seal reduces leakage past the seal without direct contact and wear between upper guard 32 and skirted pivot 34, which is not desired at the ultra-centrifugation speeds of system 10.

Without wishing to be bound by any particular theory, the term "labyrinth seal" is used herein to define the seal formed by a seal area or chamber 36 of very small clearance defined between upper guard 32 and skirted pivot 34. This seal area 36 defines a tortuous path for any fluids, mitigating the passage of such fluids through opening 26. Additionally, it is believed that features (e.g., teeth, steps, spirals, etc.) on the seal surfaces of upper guard 32, skirted pivot 34, or both can, in some instances, form fluid vortices within the chamber 36 to further ensure that any liquid that enters the chamber becomes entrapped therein, ejected and/or acts as a barrier to prevent further fluid from entering the chamber.

Skirted pivot 34 functions as a wear point at the tip of a rotating shaft of drive assembly 16. This allows the user to replace the skirted pivot 34 instead of the whole shaft when wear or damage occurs.

In some embodiments in combination with the aforementioned labyrinth seal or as a standalone feature, system 10 can be configured to provide a gas flow 40 through chamber 36 in a direction opposite to the leaking direction to mitigate such leakage. When present, this counter gas flow 40 can provide the added benefit of removing heat (e.g., cooling) from the drive assembly 16 and, hence, removing heat or at least mitigation heat load on product within system 10.

In still other embodiments in combination with one or both of the aforementioned labyrinth seal and the forced gas flow 40 or as a standalone feature, the non-contact seal assembly 16 includes a lower guard 42. The lower guard 42 can include one or more capillary channels 44 defined on an upper surface 46, which assist in collecting any fluid—particularly minute fluid amounts—that may pass through the non-contact seal assembly and direct that collected fluid away from region to be protected—namely opening 26.

During assembly, skirted pivot 34 is assembled between upper and lower guards 32, 42 with the guards sealingly secured to bearing plate 24. For example, upper and lower guards 32, 42 can be sealingly secured to bearing plate 24 with one or more o-rings 50 (two shown) by one or more fasteners 52 (three shown) as seen in FIGS. 3-4.

Once assembled, upper and lower guards 32, 42 are mounted to bearing plate 24 so that the guards remain stationary (i.e., do not rotate) during operation of drive assembly 16. Additionally once assembled, skirted pivot 34 is rotatingly positioned between guards 32, 42 to define labyrinth seal chamber 36 between an upper surface 54 of the skirted pivot and a lower surface 56 of upper guard 32.

In this manner, upper guard 32 acts as a "stator" or "stationary part" of the labyrinth seal, while skirted pivot 34 is operatively coupled to drive assembly 16 to act as a "rotor" or "moving part" of the labyrinth seal.

Figure 4:
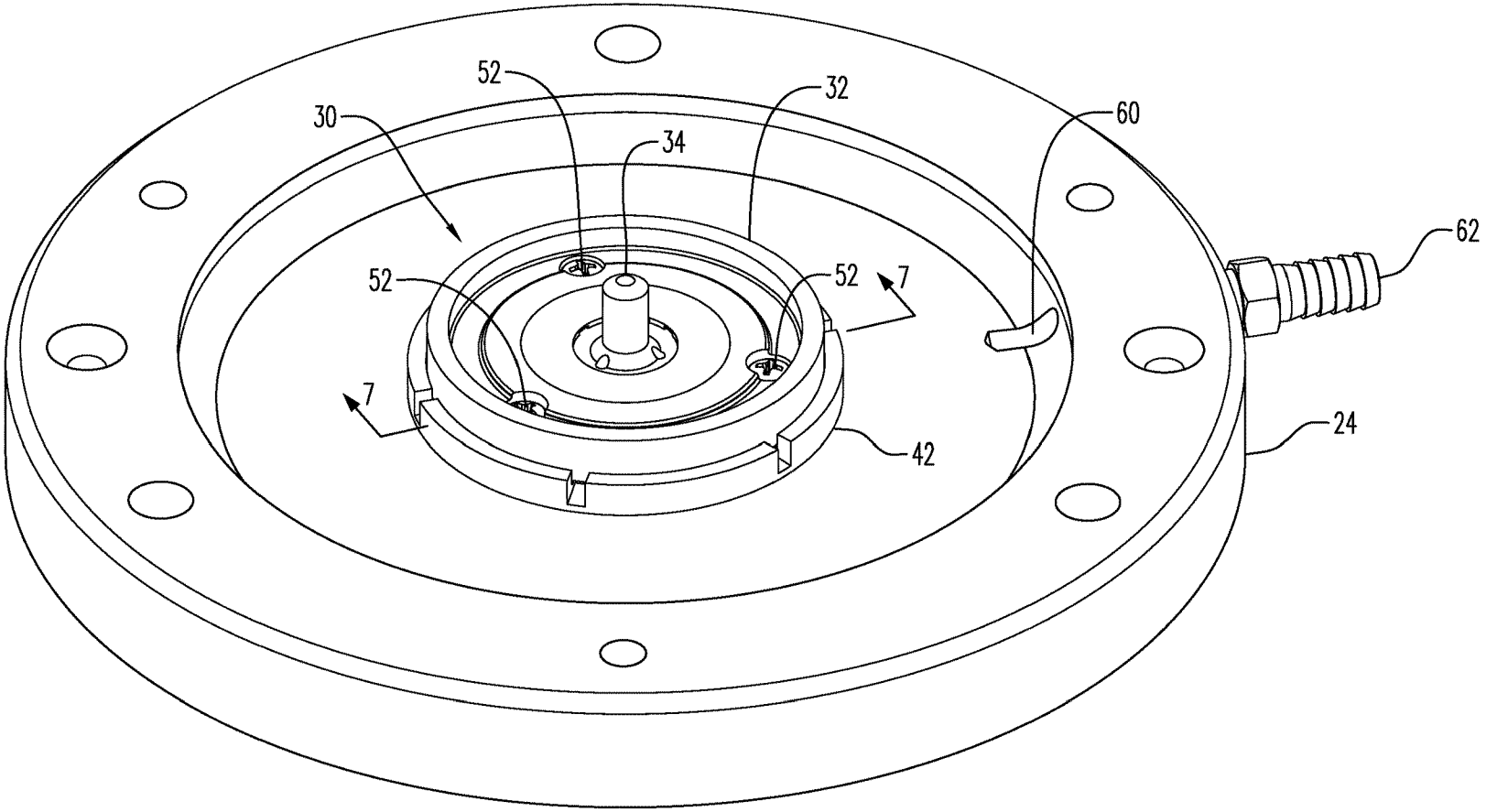
FIG. 4 is a top perspective view of an exemplary embodiment of a top bearing plate and seal assembly according to the present disclosure.
Figure 5:
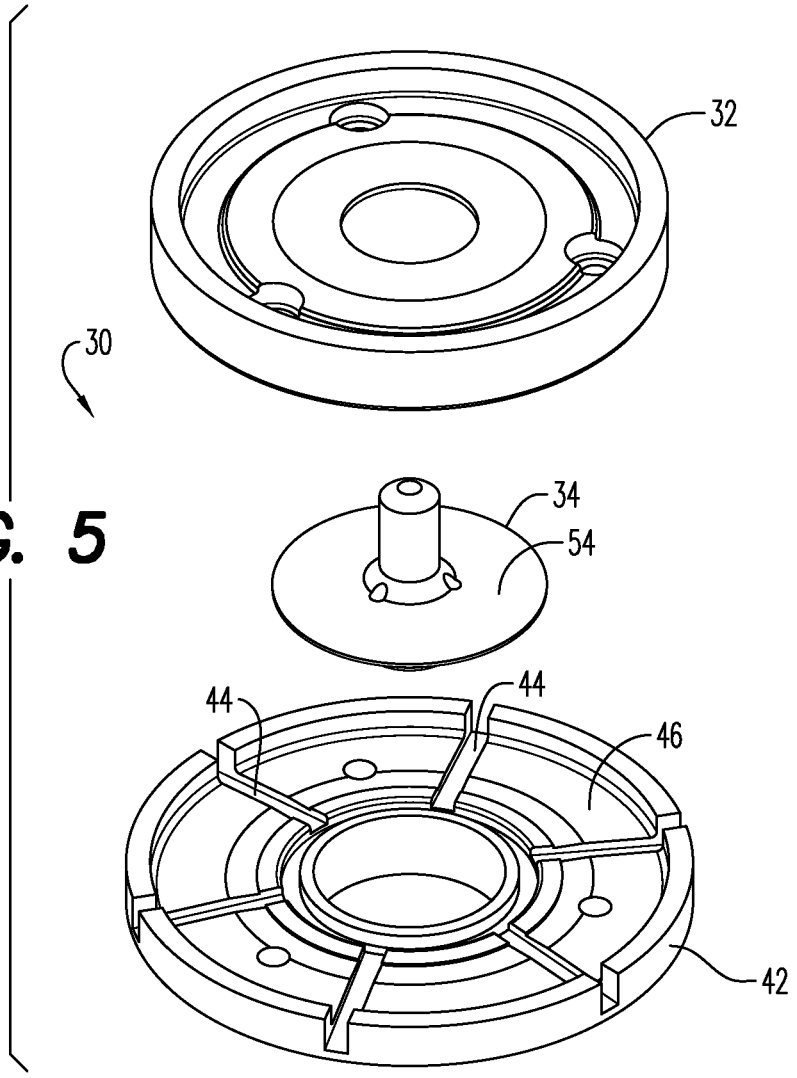
FIG. 5 is a partial exploded top perspective view of the seal assembly of FIG. 4 illustrating the upper guard, the skirted pivot, and the lower guard.
Figure 6:
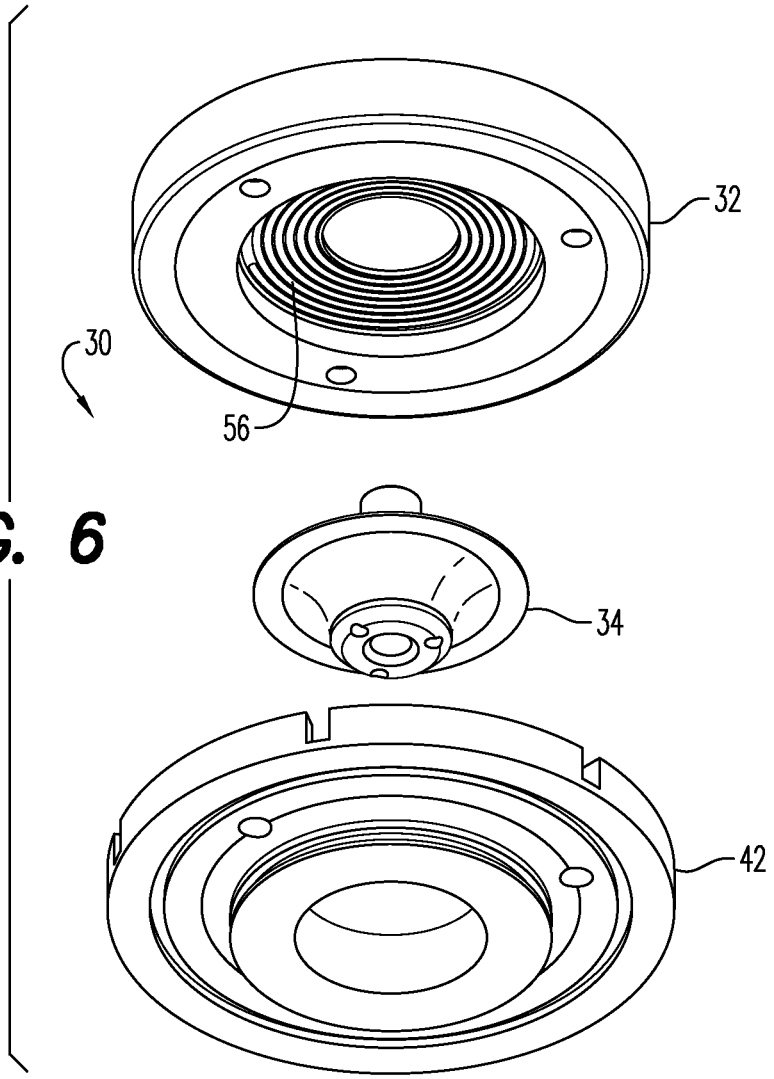
FIG. 6 is a partial exploded bottom perspective view of the seal assembly of FIG. 4.

Bearing plate 24 is, in some embodiments such as that shown in FIGS. 2-4, sloped away from opening 26 and seal assembly 30 so that fluid captured by and exiting the seal assembly at channels 44 is directed to an outer periphery 60. Preferably, bearing plate 24 further includes an outlet port 62 at outer periphery 60 through which collected fluid can be evacuated or removed from drive assembly 16.

Figure 8:
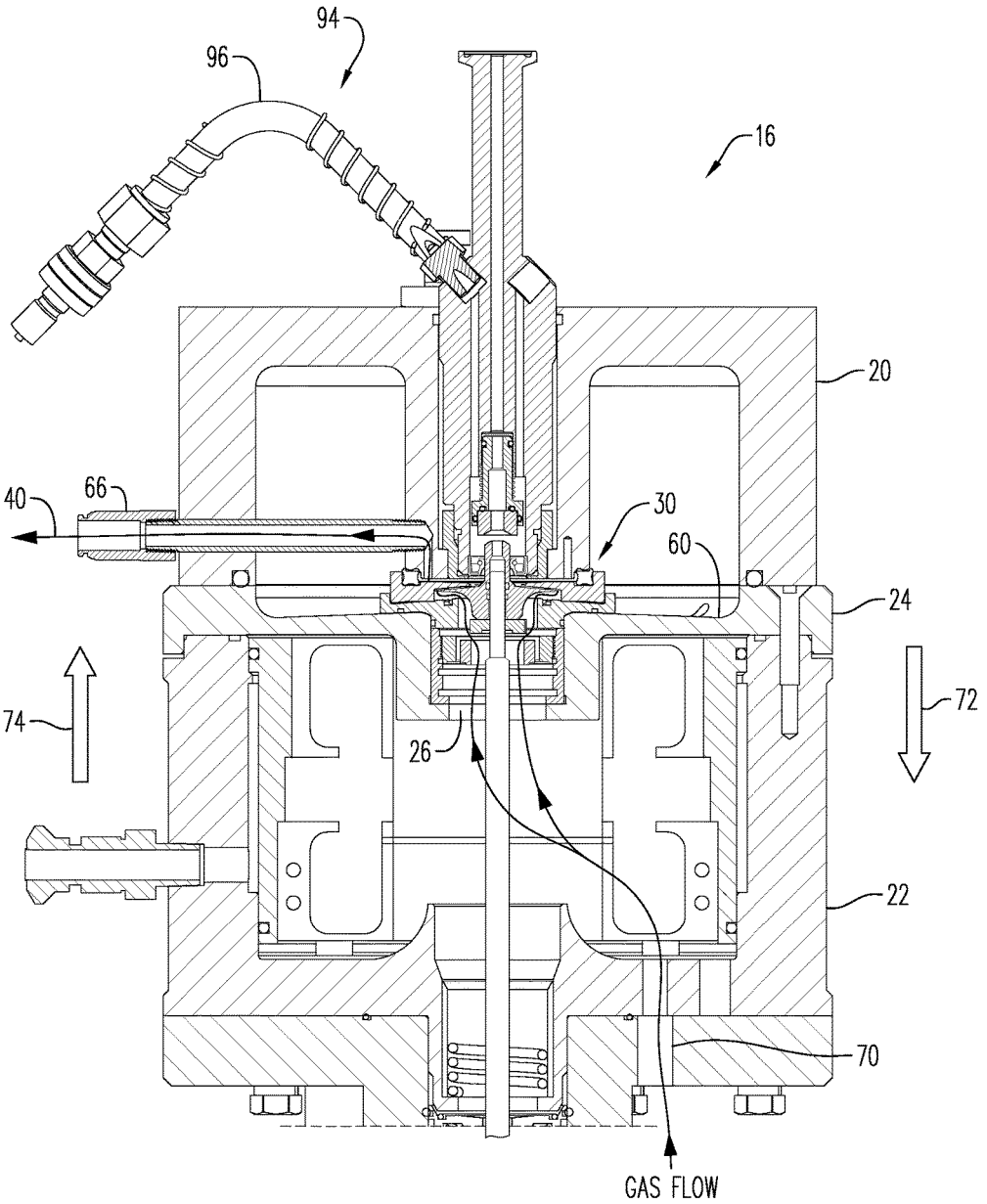
FIG. 8 is a sectional view of the drive assembly of FIG. 2 illustrating a gas flow.
Figure 9:
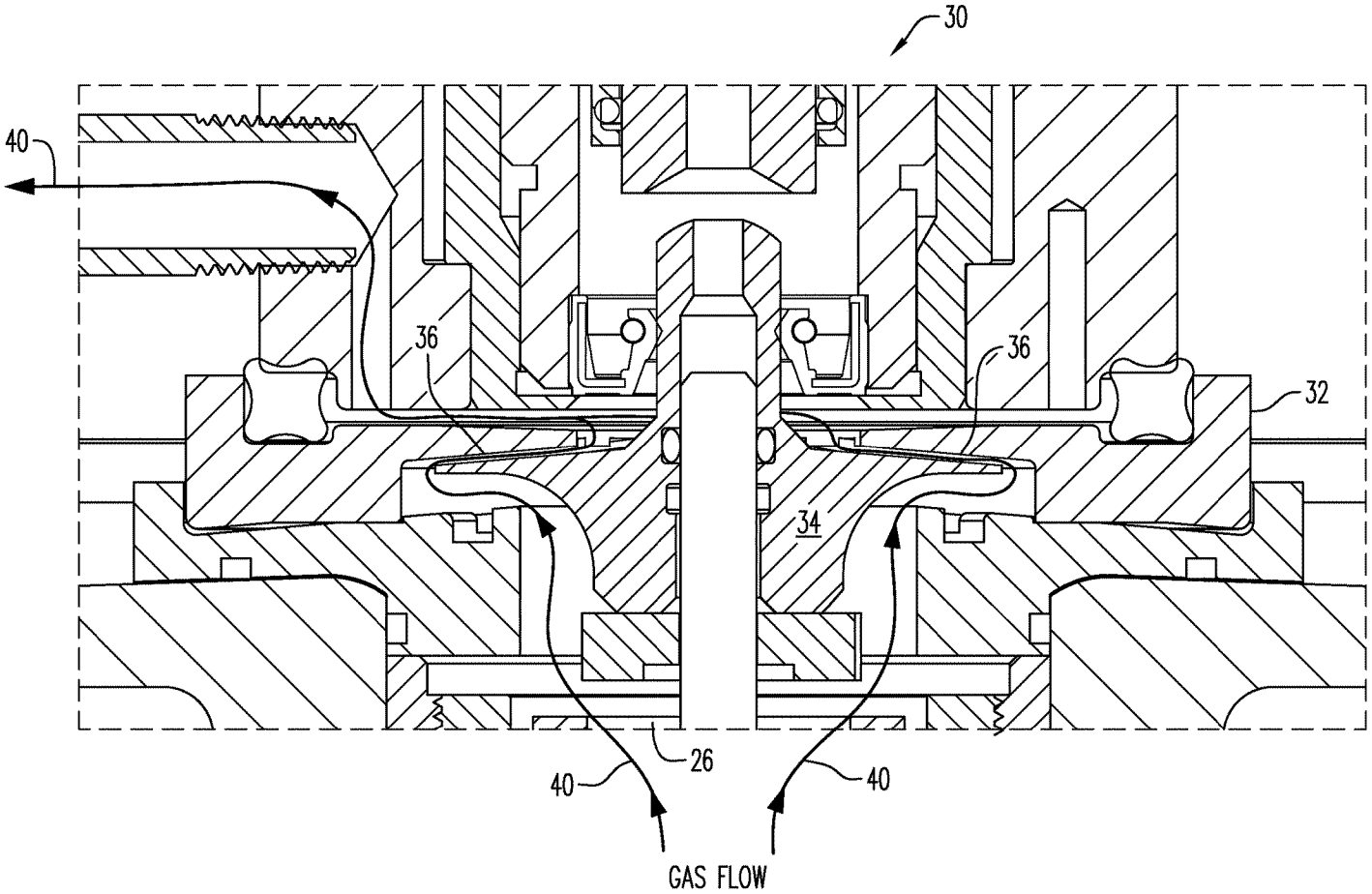
FIG. 9 is a magnified sectional view of the drive assembly of FIG. 2 illustrating the gas flow through the seal assembly.
Figure 10:
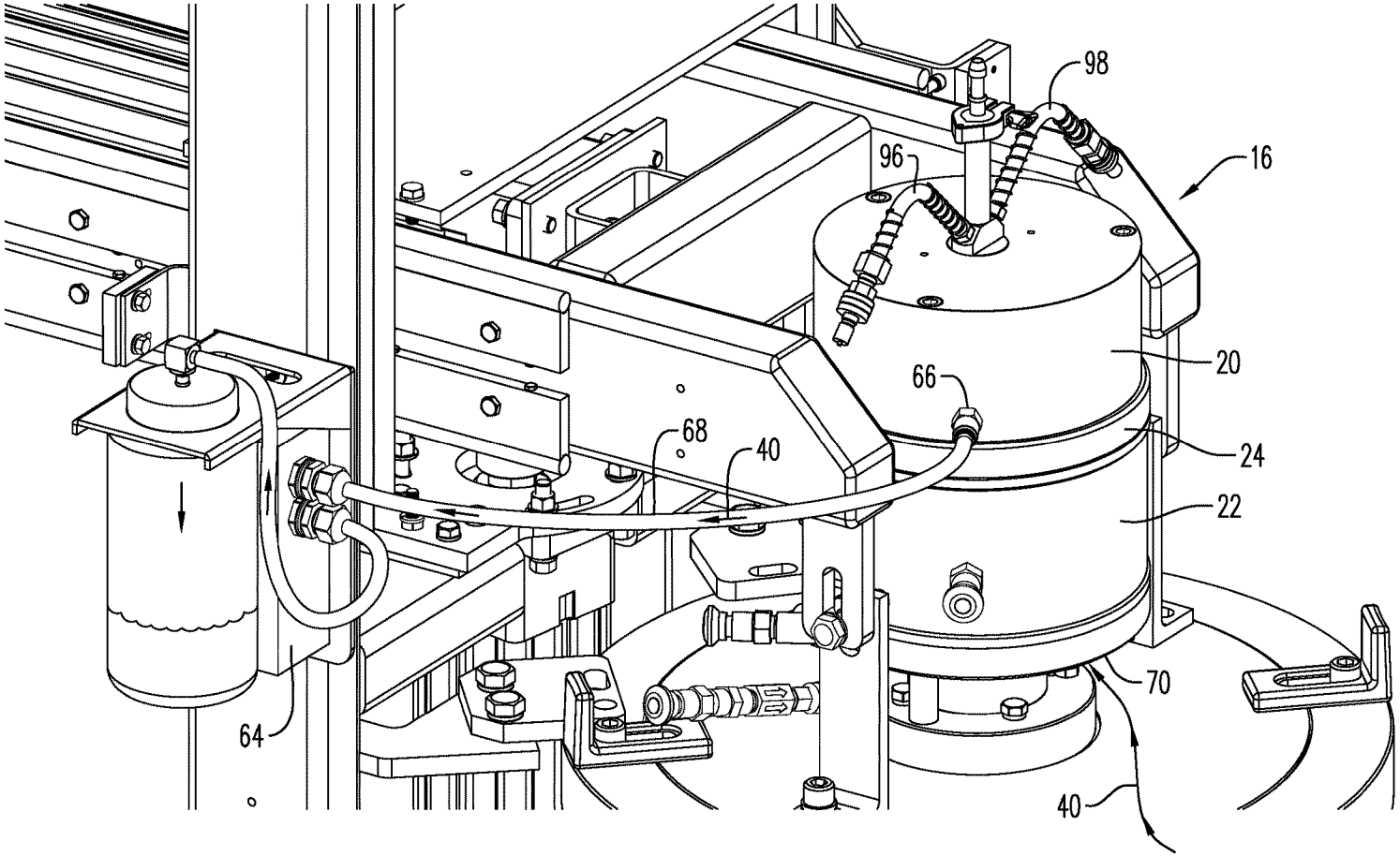
FIG. 10 is a top perspective view of the centrifugation system of FIG. 1 illustrating the gas flow.

As shown in FIGS. 8-10, system 10 can include pump 64 in fluid communication with upper housing 20 via an outlet port 66 and a conduit 68 to provide gas flow 40 through chamber 36. Pump 64 can be in electrical communication with control interface 19 to allow operator control of the pump. Further, pump 64 can be in electrical communication with drive assembly 16 so that the pump is controlled based on the operation of the drive. Here, pump 64 is illustrated as a vacuum pump that draws ambient air as gas flow 40. Pump 64 draws the air through conduit 68, outlet port 66, seal assembly 30, opening 26, and through an inlet port 70 in lower housing 22.

Simply stated, system 10 has a leakage direction 72 in the direction of gravity, namely from upper housing 20 towards lower housing 22—where the stator and rotor of the electric motor in drive assembly 16 is within the lower housing. Advantageously, system 10 establishes gas flow 40 in a direction 74 opposite or counter to the leakage direction 72.

While outlet and inlet ports 66, 70 are shown by way of example as being in upper and lower housings 20, 22, respectively, it is contemplated by the present disclosure for the ports to be anywhere within drive assembly 16 that permits gas flow 40 to flow through chamber 36 in counter direction 74.

It should also be recognized that system 10 is described by way of example with pump 64 establishing flow 40 using a vacuum of air (e.g., negative pressure). Of course, it is contemplated by the present disclosure for system 10 to establish flow 40 using any gas. Moreover, it is contemplated by the present disclosure for system 10 to establish flow 40 using a positive pressure gas source that forces the gas from inlet port 70 towards outlet port 66 or a combination of positive and negative pressure sources.

System 10 is illustrated collecting fluid from pump 64 in a collection chamber. In some embodiments, system 10 can include a sensor (not shown) in conduit 68, the collection chamber, and/or anywhere within seal assembly 26 or drive assembly 16 to detect leakage. For example, system 10 can include a volume sensor in the collection chamber such that once fluid of a certain volume is detected, the system can generate an alarm to the user to perform a system check or other remedial action. In another example, system 10 can include a flow rate sensor in the conduit 68 such that once fluid of a certain flow rate is detected and is indicative of a failure, the system can generate an alarm to the user to perform a system check or other remedial action.

Additionally, gas flow 40 can also provide the added benefit of removing heat (e.g., cooling) the drive assembly 16 and, hence, removing heat or at least mitigation heat load on product within system 10.

In some embodiments, system 10 works as a low pressure system such as under 5 pounds per square inch (psi), and high mass air flow such as over 650 milliliters per minute (mLPM). Of course, it is contemplated by the present disclosure for system 10 to provide gas flow 40 at any desired pressure or flow volume.

In some embodiments, system 10 is configured to establish gas flow 40 at different levels depending on the rotational speed of centrifuge system 10. For purposes of brevity, system 10 is described herein below establishing gas flow 40 at only two different levels, namely at a high speed and at a low speed. Of course, it is contemplated by the present disclosure for system 10 to variably control pump 64 according to the speed of drive assembly 16 in discrete increments or continuously.

Figure 11:
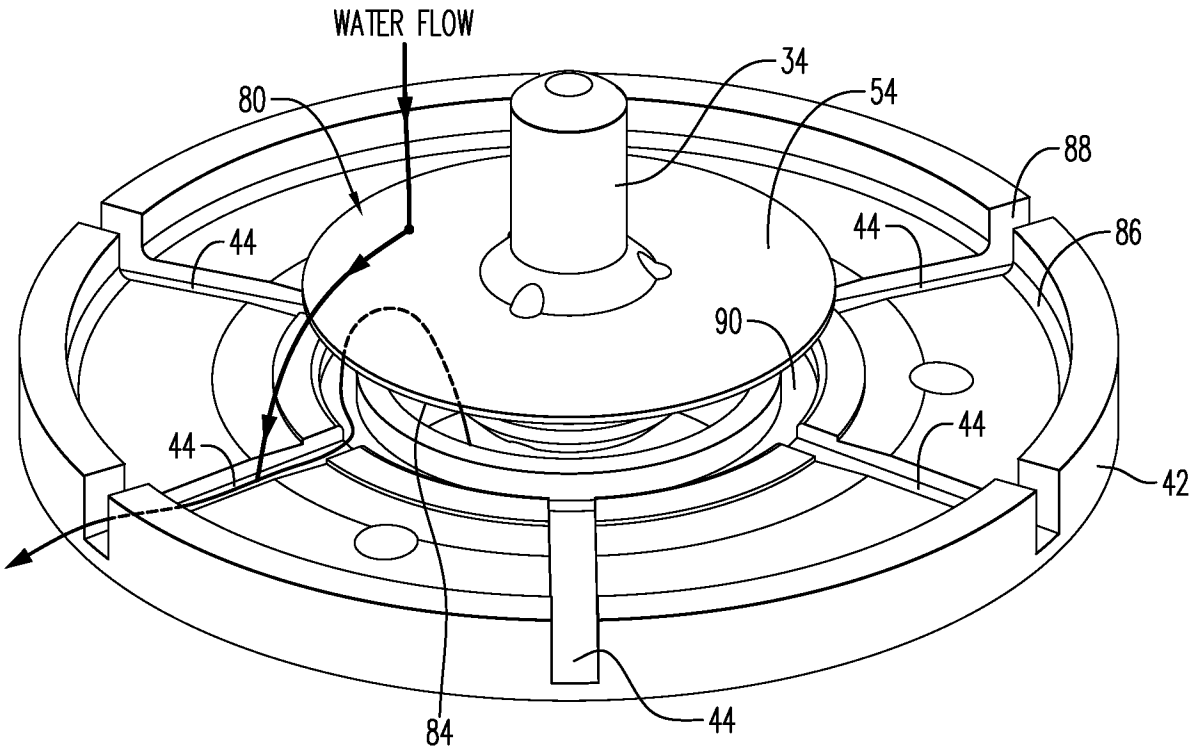
FIG. 11 is a top perspective view of the seal assembly of FIG. 4 having the upper guard removed to illustrate the skirted pivot and the lower guard.

At lower speeds of drive assembly 16, system 10 controls pump 64 so that air flow 40 is not generated. Rather during slower speeds, seal assembly 30 relies upon the slope and radial dimension of skirted pivot 34 and lower guide 42 as shown in FIGS. 7, 9, and 11 to guide liquid leaking from upper housing 20 radially outward away from opening 26.

Figure 7:
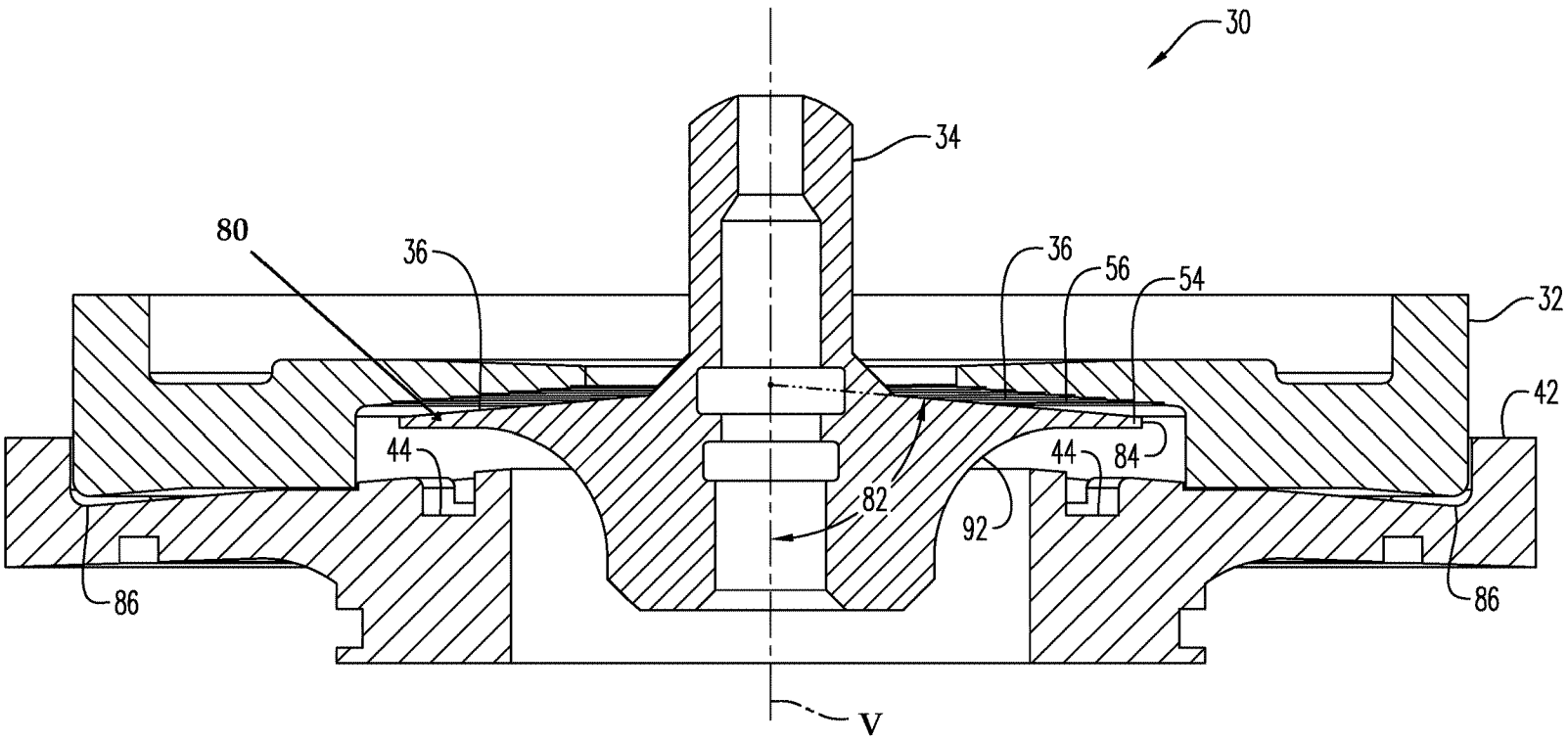
FIG. 7 is a sectional view of the seal assembly of FIG. 4.

Skirted pivot 34 has upper surface 54 defined on a skirt 80, which has an outer dimension that is larger than an inner dimension of the opening within lower guide 42 (FIG. 7). Additionally, skirt 80 is configured so that upper surface 54 has an angle 82 with respect to a vertical axis V through the central axis of skirted pivot 32. Angle 82 is preferably less than 90 degrees so that fluid captured on skirt 80 is guided towards an outer periphery 84 of the skirt.

In this manner when system 10 is controlled so that drive assembly 16, and, thus, skirted pivot 32 are rotated at lower speeds the natural force of gravity and any centrifugal forces imparted on the captured fluid will cause fluid leaking through seal assembly 30 to be captured on skirt 80 and guided radially outward towards periphery 84. Moreover, any fluid that drips from outer periphery 84 of skirt 80 is received on lower guide 42.

To further assist guiding fluid collected on lower guard 42 away from opening 26, the lower guard is also sloped away from the opening and towards its outer periphery 86. Moreover and as described above, lower guard 42 includes capillary channels 44 defined on upper surface 46, which assist in collecting any fluid and direct that collected fluid towards periphery 86 and out of the channels at openings 88.

Furthermore opening 26 and lower guard 42 are configured to allow air flow generated by the rotation of the motor within drive assembly 16 to flow upward into the space 90 below skirt 80. As shown in FIG. 11, this air flow travels up the curved lower surface 92 of the skirt and is directed outward so that any fluid falling from the periphery 84 of the skirt pushed radially outward from the periphery of the skirt.

Still further, the rotation of upper surface 54 of skirted pivot 34 with respect to lower surface 56 of upper guard 32—even at the slower speeds—is believed to generate vortices and/or pressure differentials within chamber 36 to mitigate leakage of fluid onto skirt 80.

Thus at slower speeds, seal assembly 30 forms a labyrinth seal in chamber 36 that mitigates fluid from entering or bypassing the chamber. Then, seal assembly 30 is further configured, due to the slope of upper surface 54 of skirt 80 and the airflow from the motor, to guide fluid that does bypass chamber 36 radially outward off the periphery 84 of the skirt. Finally, seal assembly 30 is further configured, due to channels 44 and the slope of lower guard 42, to guide fluid that falls off periphery 84 of skirt 80 radially outward towards periphery 86 of the lower guard, out of outlets 88, and then onto top bearing plate 24. Again, bearing plate 24 is also sloped away from opening 26 and seal assembly 30 so that fluid captured by and exiting the seal assembly at channels 44 is directed to outer periphery 60 and evacuated or removed from drive assembly 16 at outlet 66.

In sum, system 10 is configured so that when pump 64 is not controlled to generate gas flow 40 the drive assembly 16 provides a three-way cascading configuration that is aided by the vortices and/or pressure differentials generated by seal assembly 16 in chamber 36 and by the air pressure from the motor in lower housing 22 to mitigate leakage of fluid through opening 26.

However, system 10 is also configured to control pump 64 to generate gas flow 40 as needed.

For example, system 10 can be configured so that the operator can selectively turn the pump 64 on and off as desired.

Alternately, system 10 can be configured so that when drive assembly 16 rotates at higher speeds, such as above 10,000 revolutions per minute (RPM), the system controls pump 64 to generate gas flow 40.

In other embodiments, system 10 can include a fluid cooling system 94 as shown in FIG. 8, which provides cooling to drive assembly 16 as described in Applicant's U.S. Pat. No. 8,192,343. Cooling system 94 pumps coolant into upper housing 20 via a first conduit 96 and returns the coolant via a second conduit 98. In this manner, cooling system 94 is configured to cool components within upper housing 20 in a known manner. Cooling system 94 can be in electrical communication with control interface 19. Thus, system 10 can be configured to control pump 64 to generate gas flow 40 based on the activation of cooling system 94—namely to provide the gas flow when the risk of a leak in the activated cooling system within upper housing 20 is present.

Gas flow 40 is sufficient to overcome any vortices and/or pressure differentials generated in labyrinth seal chamber 36 by the rotation of upper surface 54 and lower surface 56 and to cause the air flow to pass through the chamber. Thus, gas flow 40 is believed to be sufficient to mitigate any fluid from traveling through chamber 36.

Without wishing to be bound by any particular theory, the pressure differentials and/or vortices within the labyrinth chamber 36 at the higher speeds are believed to become either sufficiently steady or unsteady that well-defined voids within the fluid flow patterns develop. These well-defined voids can allow leakage through the seal assembly 30. However since counter gas flow 40 provides a flow through chamber 36 at these high speeds, the gas flow 40 is believed to overcome, modify, or at least fill the voids in the fluid flow patterns within the chamber so as to mitigate leakage of fluid into and/or through the chamber.

Upper and lower guards 32, 42 can be made of any desired material such as, but not limited to, polyether ether ketone (PEEK) or some other polymer material so that if accidental contact is made with skirted pivot 34, the guards and/or pivot wear without disrupting the operation of the motor.

Figure 12:
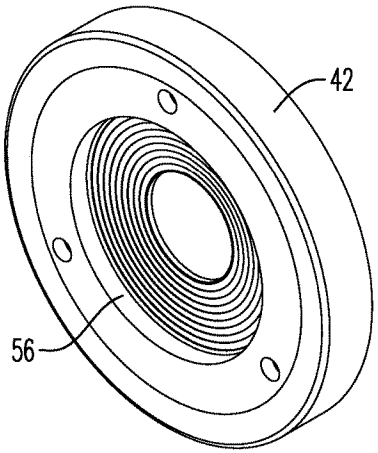
FIG. 12 is a bottom perspective view of an exemplary embodiment of the upper guard of the seal assembly.
Figure 13:
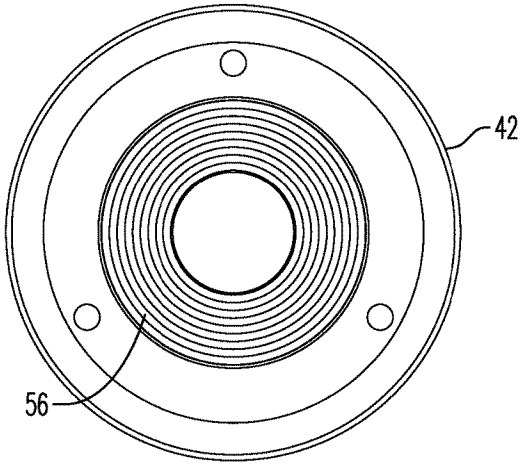
FIG. 13 is a bottom view of the upper guard of FIG. 12.
Figure 14:
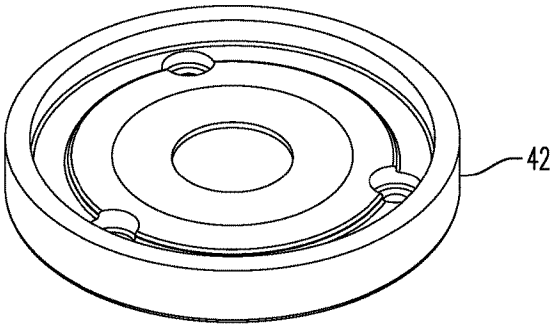
FIG. 14 is a top perspective view of the upper guard of FIG. 12.
Figure 15:
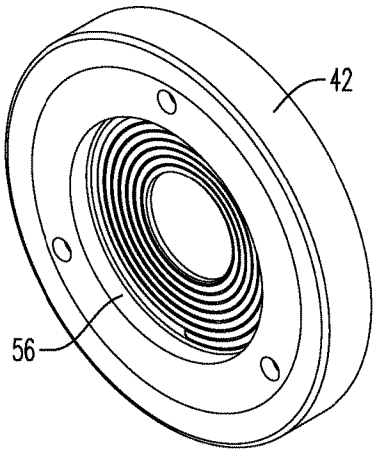
FIG. 15 is a bottom perspective view of another exemplary embodiment of the upper guard of the seal assembly.
Figure 16:
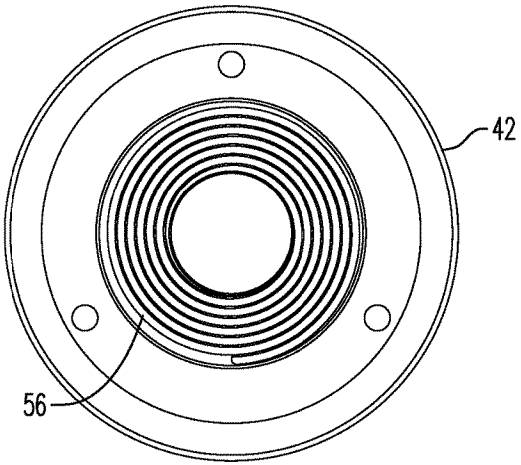
FIG. 16 is a bottom view of the upper guard of FIG. 15.
Figure 17:
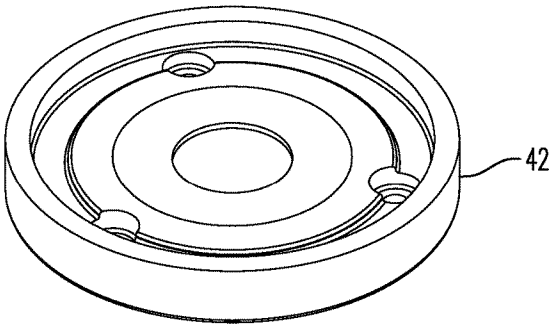
FIG. 17 is a top perspective view of the upper guard of FIG. 15.

Referring now to FIGS. 12-25, various exemplary embodiments of the features present on upper guard 32 sufficient to generate the desired labyrinth seal vortices and/or pressure differentials are shown. FIGS. 12-14 illustrate a plurality of cylindrical cuts in lower surface 56. FIGS. 15-17 illustrate a helix cut in lower surface 56.

Figure 20:
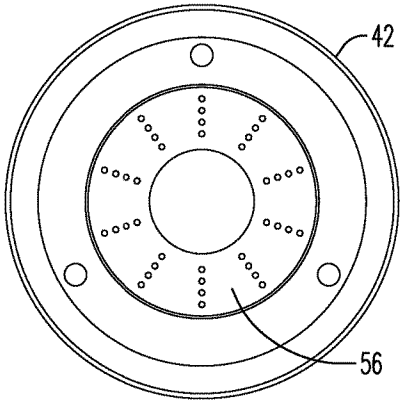
FIG. 20 is a bottom view of yet another exemplary embodiment of an upper guard according to the present disclosure.
Figure 19:
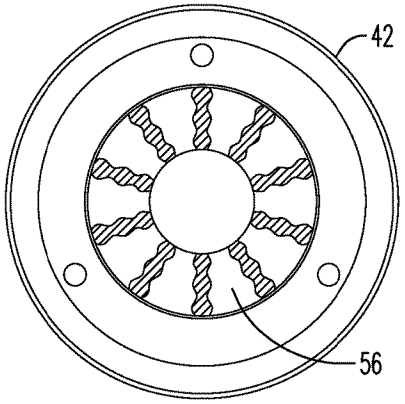
FIG. 19 is a bottom view of another exemplary embodiment of an upper guard according to the present disclosure.
Figure 18:
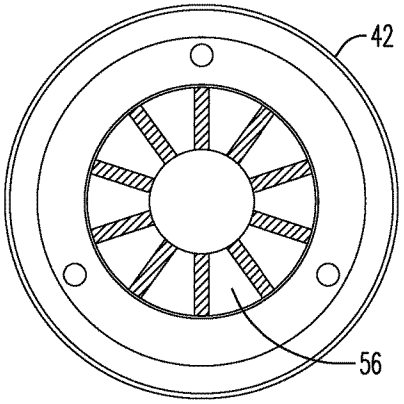
FIG. 18 is a bottom view of another exemplary embodiment of an upper guard according to the present disclosure.
Figure 21:
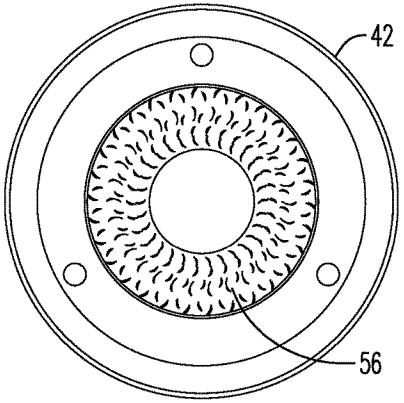
FIG. 21 is a bottom view of still another exemplary embodiment of an upper guard according to the present disclosure.

FIG. 18 illustrates a series of linear spoke-like features on lower surface 56, while FIG. 19 illustrates a series of non-linear spoke-like features on the lower surface. FIG. 20 illustrates a series of non-random features on lower surface 56, while FIG. 21 illustrates a series of random features on the lower surface. In the embodiments of FIGS. 18-21, the features can be cut or recessed into lower surface 56, can protrude from the lower surface, or combinations thereof.

Figure 22:
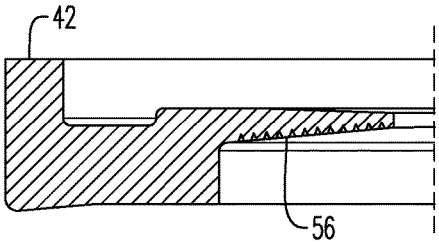
FIG. 22 is a partial sectional view of an exemplary embodiment of an upper guard according to the present disclosure.
Figure 23:
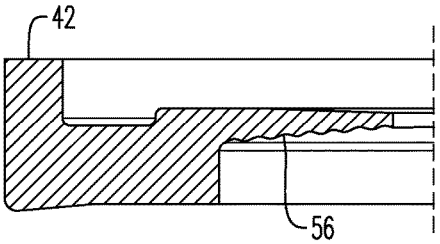
FIG. 23 is a partial section view of another exemplary embodiment of an upper guard according to the present disclosure.
Figure 24:
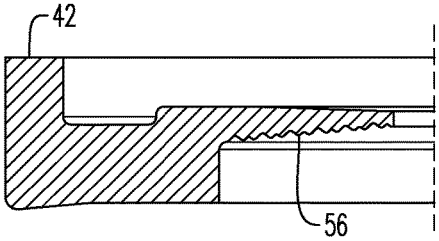
FIG. 24 is a partial sectional view of yet another exemplary embodiment of an upper guard according to the present disclosure.
Figure 25:
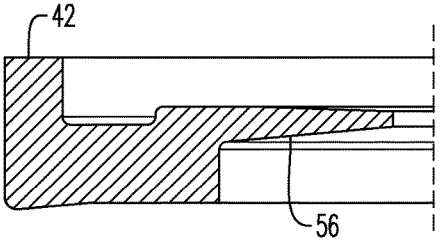
FIG. 25 is a partial sectional view of still another exemplary embodiment of an upper guard according to the present disclosure.

FIG. 22 illustrates a pattern of polygonal teeth cut into lower surface 56. FIG. 23 illustrates a regular pattern of wavy or curved teeth cut into lower surface 56, while FIG. 24 illustrates a non-regular pattern of wavy or curved teeth cut into the lower surface. FIG. 25 illustrates a planar or flat lower surface 56.

Figure 26:
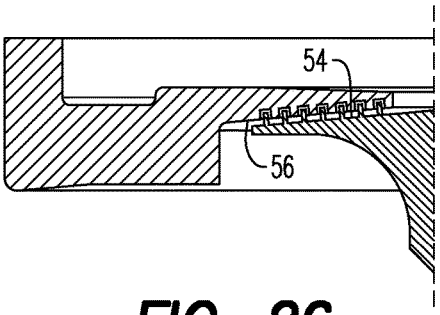
FIG. 26 is a partial sectional view of an embodiment of an upper guard and skirted pivot according to the present disclosure.

It should be recognized that seal assembly 30 has been described above by way of example having features present on lower surface 56 of upper guard 32 that generate the vortices and/or pressure differentials in chamber 36. Of course, it is contemplated by the present disclosure for these features to be present on upper surface 54 of skirted pivot 34. Moreover, it is contemplated by the present disclosure for the features to be present on both lower and upper surfaces 54, 56 as illustrated in FIG. 26.

In embodiments where the features are present on upper surface 54 of skirted pivot 34, it is preferred that such features have radial channels (not shown) defined therein—similar to channels 44 on lower guard 42—to guide any fluid on the upper surface towards outer periphery 84.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure. Therefore, it is intended that the present disclosure not be limited to the particular embodiment(s) disclosed as the best mode contemplated.

What is claimed is:

1. A centrifugation system comprising:

a drive assembly having an upper housing and a lower housing separated by a top bearing plate with a rotor opening defined therein, the lower housing having a drive disposed therein with a rotor shaft aligned with the rotor opening;

a non-contact seal assembly having an upper guard and a skirted pivot, the non-contact seal assembly being secured to the top bearing plate at the rotor opening so that the skirted pivot is operatively coupled to the rotor shaft for rotation without contacting the upper guard with the upper guard and the skirted pivot forming a labyrinth seal to mitigate leakage of fluid from the upper housing through the rotor opening into the drive in the lower housing; and a tank assembly having a centrifuge rotor rotatably housed therein, the tank assembly being connectable to the lower housing so that the centrifuge rotor is rotatably driven by the drive via the rotor shaft.

2. The centrifugation system of claim 1, wherein the drive is a pneumatic drive or an electric drive.

3. The centrifugation system of claim 1, further comprising a pressure source providing a gas flow between a lower surface of the upper guard and an upper surface of the skirted pivot, the gas flow having a direction opposite to a fluid leaking direction through the rotor opening.

4. The centrifugation system of claim 3, wherein the pressure source is sufficient to remove heat from the drive.

5. The centrifugation system of claim 3, wherein the pressure source is a positive or negative pressure source.

6. The centrifugation system of claim 1, further comprising a lower guard secured to the upper guard with the skirted pivot rotatably positioned therebetween without contacting the upper or lower guards.

7. The centrifugation system of claim 6, wherein the lower guard comprises a capillary channel defined on an upper surface of the skirted pivot, the capillary channel being sloped away from the rotor opening.

8. The centrifugation system of claim 7, wherein the upper surface of the skirted pivot has an outer dimension that is larger than an inner dimension of an opening within the lower guide.

9. The centrifugation system of claim 8, wherein the upper surface has an angle with respect to a vertical axis through a central axis of the skirted pivot, the angle being sufficient so that fluid captured on the skirted pivot is guided towards the outer dimension.

10. The centrifugation system of claim 1, wherein the skirted pivot forms a wear point at a tip of the rotor shaft of the drive.

11. The centrifugation system of claim 1, wherein the skirted pivot is removably received in the non-contact seal assembly so that the skirted pivot is replaceable.

12. The centrifugation system of claim 1, further comprising one or more features on seal surfaces of the upper guard and/or skirted pivot, the one or more features forming fluid vortices within the non-contact seal assembly sufficient to mitigate leakage of the fluid from the upper housing through the rotor opening into the drive in the lower housing.

13. The centrifugation system of claim 12, further comprising a pressure source providing a gas flow between a lower surface of the upper guard and an upper surface of the skirted pivot, the gas flow having a direction opposite to a fluid leaking direction through the rotor opening.

14. The centrifugation system of claim 13, wherein the gas flow is sufficient to overcome any vortices and/or pressure differentials generated by the rotation of the skirted pivot.

15. The centrifugation system of claim 1, wherein the top bearing plate is sloped away from the rotor opening so that fluid captured by and exiting the non-contact seal assembly is directed to an outer periphery of the skirted pivot.

16. The centrifugation system of claim 15, wherein the top bearing plate further comprises an outlet port at the outer periphery through which fluid can be evacuated from the drive assembly.

17. The centrifugation system of claim 16, further comprising an evacuation pump, the evacuation pump providing a gas flow between a lower surface of the upper guard and an upper surface of the skirted pivot, the gas flow having a direction opposite to a fluid leaking direction through the rotor opening, and the evacuation pump evacuating fluid from the outlet port at the outer periphery.

18. A centrifugation system comprising:

a drive assembly having an upper housing and a lower housing separated by a top bearing plate with a rotor opening defined therein, the lower housing having a drive disposed therein with a rotor shaft aligned with the rotor opening;

a non-contact seal assembly having an upper guard and a skirted pivot, the non-contact seal assembly being secured to the top bearing plate at the rotor opening so that the skirted pivot is operatively coupled to the rotor shaft for rotation without contacting the upper guard with the upper guard and the skirted pivot forming a labyrinth seal to mitigate leakage of fluid from the upper housing through the rotor opening into the drive in the lower housing;

a tank assembly having a centrifuge rotor rotatably housed therein, the tank assembly being connectable to the lower housing so that the centrifuge rotor is rotatably driven by the drive via the rotor shaft; and one or more features on seal surfaces of the upper guard and/or skirted pivot, the one or more features forming fluid vortices within the non-contact seal assembly sufficient to mitigate leakage of the fluid from the upper housing through the rotor opening into the drive in the lower housing.

19. The centrifugation system of claim 18, further comprising a pressure source providing a gas flow between a lower surface of the upper guard and an upper surface of the skirted pivot, the gas flow having a direction opposite to a fluid leaking direction through the rotor opening.

20. The centrifugation system of claim 19, wherein the gas flow is sufficient to overcome any vortices and/or pressure differentials generated by the rotation of the skirted pivot.

21. A centrifugation system comprising:

a drive assembly having an upper housing and a lower housing separated by a top bearing plate with a rotor opening defined therein, the lower housing having a drive disposed therein with a rotor shaft aligned with the rotor opening;

a non-contact seal assembly having an upper guard and a skirted pivot, the non-contact seal assembly being secured to the top bearing plate at the rotor opening so that the skirted pivot is operatively coupled to the rotor shaft for rotation without contacting the upper guard with the upper guard and the skirted pivot forming a labyrinth seal to mitigate leakage of fluid from the upper housing through the rotor opening into the drive in the lower housing; and a tank assembly having a centrifuge rotor rotatably housed therein, the tank assembly being connectable to the lower housing so that the centrifuge rotor is rotatably driven by the drive via the rotor shaft, wherein the top bearing plate is sloped away from the rotor opening so that fluid captured by and exiting the non-contact seal assembly is directed to an outer periphery of the skirted pivot.

22. The centrifugation system of claim 21, wherein the top bearing plate further comprises an outlet port at the outer periphery through which fluid can be evacuated from the drive assembly.

23. The centrifugation system of claim 22, further comprising an evacuation pump, the evacuation pump providing a gas flow between a lower surface of the upper guard and an upper surface of the skirted pivot, the gas flow having a direction opposite to a fluid leaking direction through the rotor opening, and the evacuation pump evacuating fluid from the outlet port at the outer periphery.

* * * * *